United States Patent [19]

Atkinson

[11] Patent Number: 4,655,687

[45] Date of Patent: Apr. 7, 1987

[54] ROTORS FOR GAS TURBINE ENGINES

[75] Inventor: John H. M. Atkinson, Derby, England

[73] Assignee: Rolls-Royce, London, England

[21] Appl. No.: 823,649

[22] Filed: Jan. 29, 1986

[30] Foreign Application Priority Data

Feb. 20, 1985 [GB] United Kingdom ..... 8504358

[51] Int. Cl.[4] ..... F01D 5/22; F01D 5/32

[52] U.S. Cl. ..... 416/193 A; 416/190; 416/196 R; 416/221

[58] Field of Search ..... 416/193 R, 193 A, 196 R, 416/190, 219–221, 241 B

[56] References Cited

U.S. PATENT DOCUMENTS

| | | | |
|---|---|---|---|
| 3,008,689 | 11/1961 | Morley et al. | 416/193 A |
| 3,294,364 | 12/1966 | Stanley | 416/219 R |
| 3,712,757 | 1/1973 | Goodwin | 416/196 R X |
| 3,784,320 | 1/1974 | Rossmann et al. | 416/219 R X |
| 3,801,220 | 4/1974 | Beckershoff | 416/193 A X |
| 3,905,722 | 9/1975 | Guy et al. | 416/193 A |
| 3,910,719 | 10/1975 | Hessler et al. | 416/219 R X |
| 4,169,694 | 10/1979 | Sanday | 416/219 R |
| 4,175,912 | 11/1979 | Crane et al. | 416/193 A |
| 4,343,593 | 8/1982 | Harris | 416/193 A |

FOREIGN PATENT DOCUMENTS

| | | | |
|---|---|---|---|
| 216406 | 5/1958 | Australia | 416/193 A |
| 1025421 | 3/1958 | Fed. Rep. of Germany | 416/219 |
| 989556 | 9/1951 | France | 416/193 A |
| 1341910 | 9/1963 | France | 416/193 A |
| 811922 | 4/1959 | United Kingdom | 416/219 |
| 2006883 | 5/1979 | United Kingdom | 416/193 A |

*Primary Examiner*—Everette A. Powell, Jr.

*Attorney, Agent, or Firm*—Cushman, Darby & Cushman

[57] ABSTRACT

A rotor assembly for a gas turbine engine has platformless blades and the inner wall of the compressed air annulus is made up of separate annulus members bridging the spaces between pairs of adjacent blades. The invention provides salient feet on the annulus members which are fitted through the narrow necks of re-entrant grooves in a direction radially inwardly of the rotor disc. Wedges are slid between feet and the walls of the grooves to prevent removal of the feet and therefore the annulus members in a reciprocal direction.

7 Claims, 6 Drawing Figures

ROTORS FOR GAS TURBINE ENGINES

The present invention relates to air compressing rotors for a gas turbine engine. More specifically, the invention relates to the construction of an air compressing rotor for a gas turbine engine, which rotor may comprise a compressor rotor or a fan rotor. The invention has particular efficacy in connection with the latter.

It is known to construct a fan stage comprising a disc and a number of fan blades the radially inner ends of which are inserted in grooves in the rim of the fan disc. The known fan blades do not have platforms with which to form the inner wall of the fan annulus and to compensate for this, it is known to fasten hollow, thin wall members to the periphery of the disc in between adjacent pairs of fan blades. The side walls of the members closely fit against the sides of adjacent blades, thus bridging the gap and providing an annulus wall.

The fastening of the members to the disc has been by bolts in one example and adhesion in another example. A further example comprised providing each hollow member with a straight, elongate foot and further providing complementary grooves in the rim of the disc. Fitting was achieved by sliding the foot into a groove in a direction axially of the disc.

All of the members mentioned hereinbefore were manufactured from a composite material i.e., fibre reinforced resin and all failed due to lack of resistance to peeling from the fan structure, under the action of centrifugal force. Aluminium structures have also been tested, but here, the centrifugal loads caused the fastenings to fracture.

The present invention seeks to provide an improved construction of gas turbine engine rotor.

According to the present invention a rotor assembly for a gas turbine engine comprises a rotor disc supporting a peripherally arranged plurality of blades, re-entrant grooves in the disc rim and extending through the thickness thereof, one said re-entrant groove between each pair of adjacent blades, annulus wall members bridging the space between adjacent blades, each annulus wall member having a salient foot shaped similarly to the grooves and proportioned so as to pass radially of the disc through the neck of a respective groove and wedges positioned between opposing walls of the grooves and respective feet so as to prevent withdrawal of the feet in a direction radially outwardly of the disc.

Preferably the re-entrant grooves and cooperating salient feet are of dovetail cross-sectional shape and the opposing walls thereof slope.

Preferably each annulus member comprises an arcuate annulus wall portion and includes a leg which is positioned centrally of and projects radially from the surface thereof and terminates in a said salient foot, and wherein both leg and foot extend generally axially of the disc.

Each leg portion may be curved about a datum line centrally thereof and radially of the disc.

Each salient foot may be curved about a datum line centrally thereof and radially of the disc.

Preferably the annulus wall portion is constructed from a composite material.

The composite material may comprise a carbon fibre reinforced thermoplastic polymer.

The annulus wall portion may include blade abutting edges manufactured from a non reinforced thermoplastic polymer.

The invention will now be described, by way of example and with reference to the accompanying drawings in which.

Figure 1:
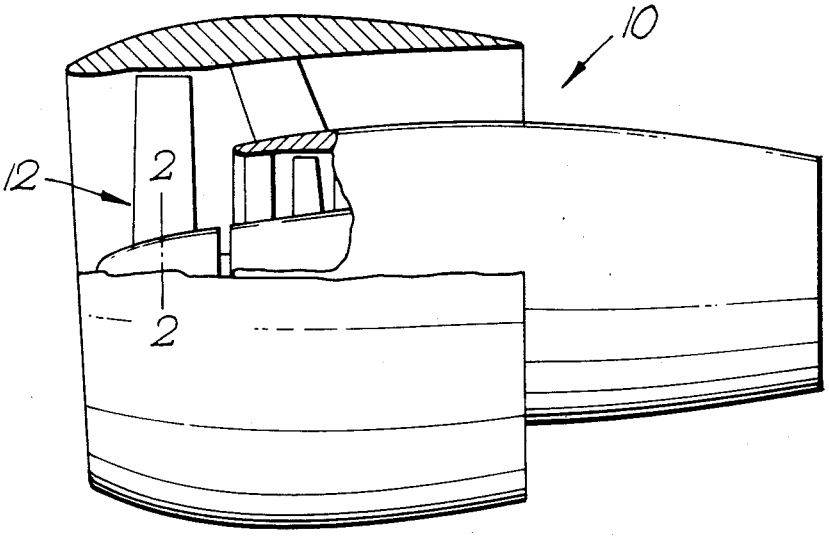
FIG. 1 is a diagrammatic view of a gas turbine engine incorporating an embodiment of the present invention.

Referring to FIG. 1. A gas turbine engine power plant 10 includes a front fan 12. Such power plants are well known in the art and therefore, will not be described in detail.

The front fan 12 however, of the present example, does include novel features which are described hereinafter, with reference in the first instance to FIG. 2.

Figure 2:
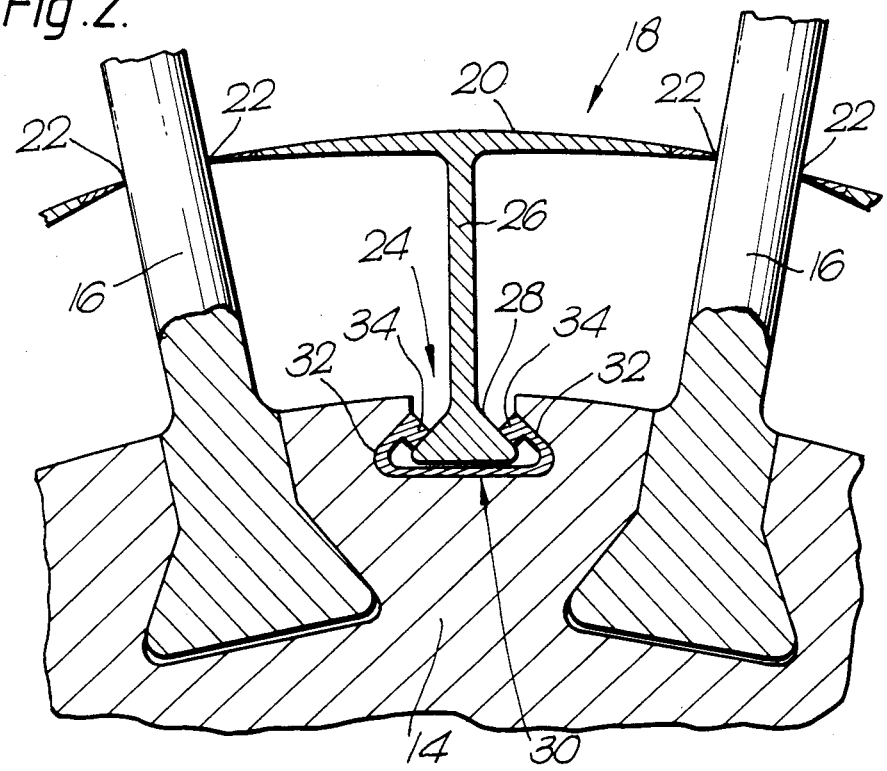
FIG. 2 is a view on line 2—2 of FIG. 1.

In FIG. 2, the fan rotor disc 14 supports a number or radially aligned fan blades 16 in known manner. The fan blades 16 do not have any platforms i.e., four sided, substantially plane portions which abut to provide an inner fan annulus wall. Instead, separate members 18 are provided. Each member 18 is substantially 'T' shaped and has length, such that the portion 20 which provides the head of the 'T' has area. Thus the side edges 22 of the head portions 20 abut the blades of adjacent fan blades 16 along the full chordal lengths thereof and in so doing, collectively form an inner fan annulus wall.

The rim of the rotor disc 14 contains a groove 24 between each adjacent pair of fan blades 16. Each groove 24 extends through the thickness of the rotor disc and is of re-entrant cross-sectional shape, i.e., its interior is wider than its entrance. The walls of the groove 24 converge towards the entrance thereof.

The leg 26 of each T member 18 terminates in an elongate, salient foot 28, the shape of which is similar to the shape of a groove 24. The width of each foot 28 however, is such as to enable it to be inserted in close sliding relationship through the neck of a respective groove 24, in a direction radially of the disc 14. A considerable space thus exists between each foot 28 and the walls of their respective grooves 24. A wedge 30 is inserted between each foot 28 and the walls of its respective groove 24 in a direction axially of the disc 14. Each wedge 30 is generally 'U' shaped in cross section and each arm 32 of the wedge 30 terminates in a thickened portion 34. The thickened portions 34 fill the space between the sloping flanks of the feet 28 and the corresponding sloped walls of the grooves 24 and thus prevent removal of the feet 28 from the grooves 24 in directions radially of the disc 14 and moreover, transfer operating loads from the feet 28 to the disc 14. Conventional means, e.g., hooks (not shown) on the feet 28 may be utilised for locating the annulus members 18 against the rim of the disc 14 so as to prevent movement axially of the disc 14.

Figure 3:
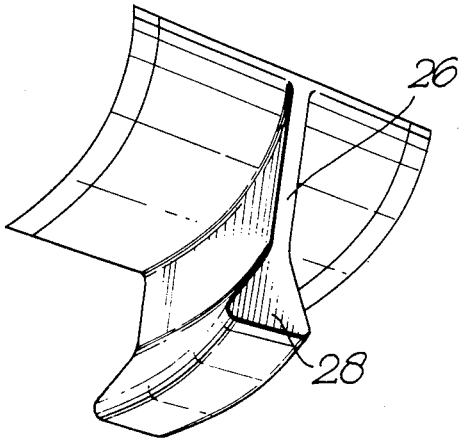
FIGS. 3 to 6 depict alternative forms which the present invention may embody.
Figure 4:
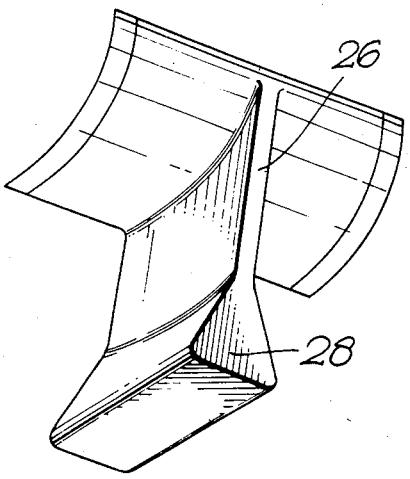

Referring to FIG. 3, the bending resistance exhibited by the annulus member 18 may be enhanced by forming the leg 26 and the foot 28 in a curve. Alternatively, the leg 26 may be curved, and the foot 28 may be straight as in FIG. 4. If as is shown in FIG. 3, the foot 28 is curved, the slot 24 and the wedge 30 (not shown) in FIG. 3 must be correspondingly curved.

Figure 5:
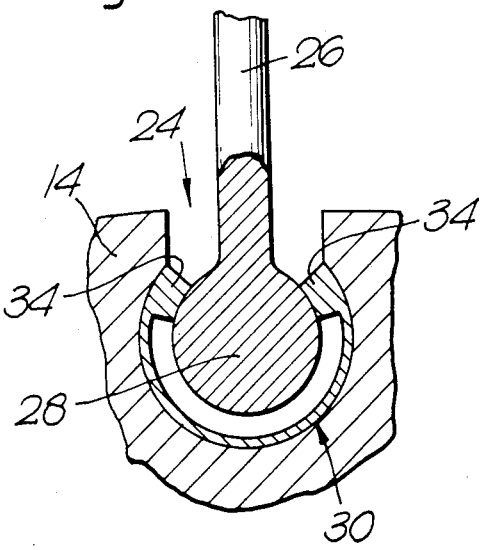

Referring now to FIG. 5 in which parts which correspond to those parts depicted in FIG. 2 have like numerals. The foot 28 is circular in cross section and the groove 24 has a similar shape and again is re-entrant. A generally circular wedge 30 has thickend portions 34 which prevent the foot 28 from being withdrawn from the groove 24 in a direction radially outwardly of the disc 14 and furthermore, transfer operating loads from the foot 28, to the disc 14.

Figure 6:
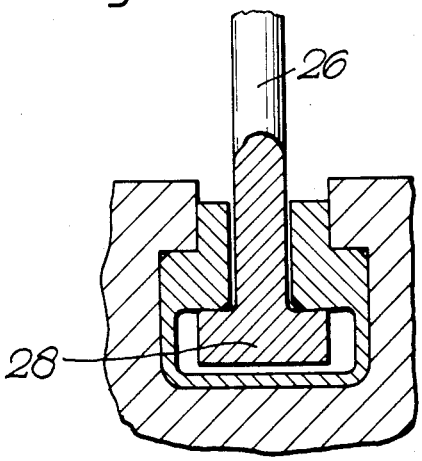

In FIG. 6, the respective parts are generally rectangular, but nevertheless cooperate in the same way as is described with reference to FIGS. 2 and 5. Moreover, the legs 26 and feet 28 in FIGS. 5 and 6 may be curved as described with reference to FIGS. 3 and/or 4.

The annulus member 18 described herein with reference to FIGS. 2 to 6 may be moulded from a thermoplastic polymer such as polyetheretherketone, which is reinforced by the inclusion of 30% by weight of a chopped carbon fibre. The edge portions 22 which engage the flanks of the blades 16 may be unreinforced polyetheretherketone which is placed in strip form in a mould into which the heated, reinforced material is thereafter injected.

The wedge 30 may be made from aluminum but will then require plating with an outer friction facing material. Alternatively, the wedges may be made from polyetheretherketone which is reinforced with chopped carbon fibre.

I claim:

1. A rotor assembly for a gas turbine engine comprising a rotor disc supporting a peripherally arranged plurality of blades, re-entrant grooves being provided in the disc rim which extend through the thickness thereof, one said re-entrant groove being located between each pair of adjacent blades, annulus wall members bridging the space between each pair of adjacent blades, each annulus wall member having a salient foot shaped similarly to the re-entrant grooves and proportioned so as to pass through the neck of a respective re-entrant groove in a direction radially inwardly of the disc and wedges positioned between the opposing walls of cooperating re-entrant grooves and salient feet so as to prevent withdrawal of the feet in a direction radially outwardly of the disc.

2. A rotor assembly as claimed in claim 1 in which the re-entrant grooves and cooperating salient feet are of dovetail cross-sectional shape.

3. A rotor assembly as claimed in claim 1 or claim 2 wherein each annulus member comprises an arcuate annulus wall portion and includes a leg which is positioned centrally of and projects radially from the radially inner surface thereof and terminates in a said salient foot and wherein both leg and salient foot extend generally axially of the disc.

4. A rotor assembly as claimed in claim 3 wherein each leg is curved in planes normal to its radial extent.

5. A rotor assembly as claimed in claim 4 wherein said salient feet are curved in planes normal to the radial extent of their respective legs.

6. A rotor assembly for a gas turbine engine comprising a rotor disc supporting a peripherally arranged plurality of blades, re-entrant grooves being provided in the disc rim which extend through the thickness thereof, one said re-entrant groove being located between each pair of adjacent blades, annulus wall members bridging the space between each pair of adjacent blades, each annulus wall member having a salient foot shaped similarly to the re-entrant grooves and proportioned so as to pass through the neck of a respective re-entrant groove in a direction radially inwardly of the disc and wedges positioned between the opposing walls of cooperating re-entrant grooves and salient feet so as to prevent withdrawal of the feet in a direction radially outwardly of the disc, and wherein the annulus wall members are manufactured from a carbon fibre reinforced thermoplastic polymer.

7. A rotor assembly as claimed in claim 6 wherein the annulus members include blade engaging edges manufactured from a non-reinforced thermoplastic polymer.

* * * * *